US005228511A

United States Patent [19]

Boquel et al.

[11] Patent Number: 5,228,511

[45] Date of Patent: Jul. 20, 1993

[54] MOTOR VEHICLE HEAT EXCHANGER HAVING TWO INTERCONNECTED WATER BOXES

[75] Inventors: Dany Boquel, Ablis; Bernard Levy, Courbeovie; Norman Golm, Paris, all of France

[73] Assignee: Valeo Thermique Moteur, Le Mesnil-Saint-Denis, France

[21] Appl. No.: 850,117

[22] Filed: Mar. 12, 1992

[30] Foreign Application Priority Data

Mar. 12, 1991 [FR] France ..... 91 02981

[51] Int. Cl.[5] ..... F28F 9/26

[52] U.S. Cl. ..... 165/149; 165/81

[58] Field of Search ..... 165/81, 67, 149

[56] References Cited

U.S. PATENT DOCUMENTS

| | | | |
|---|---|---|---|
| 2,506,051 | 5/1950 | Young | 165/149 X |
| 3,897,738 | 8/1975 | Minsky et al. | 108/119 |
| 4,507,917 | 4/1985 | Kandler | 60/323 |
| 4,540,044 | 9/1985 | Lenz | 165/149 |
| 4,593,163 | 6/1986 | Fisher | 200/80 R |
| 4,678,026 | 7/1987 | Lenz et al. | 165/67 |

FOREIGN PATENT DOCUMENTS

| | | | |
|---|---|---|---|
| 1939135 | 5/1980 | Fed. Rep. of Germany | 165/149 |
| 2123943A | 2/1984 | United Kingdom | 165/149 |

*Primary Examiner*—Allen J. Flanigan

*Attorney, Agent, or Firm*—Morgan & Finnegan

[57] ABSTRACT

A heat exchanger comprises a bundle of tubes connected between two water boxes, each of the latter being delimited by a wall of moulded plastics material having two opposed, lateral faces on which are secured lateral portions of two mountings which join the two water boxes together and which enclose the tube bundle between them. Each water box is secured to each mounting by means of at least one self-tapping screw which passes through an aperture formed in a lateral portion of the mounting and which engages in a bore formed in the wall of the water box.

6 Claims, 2 Drawing Sheets

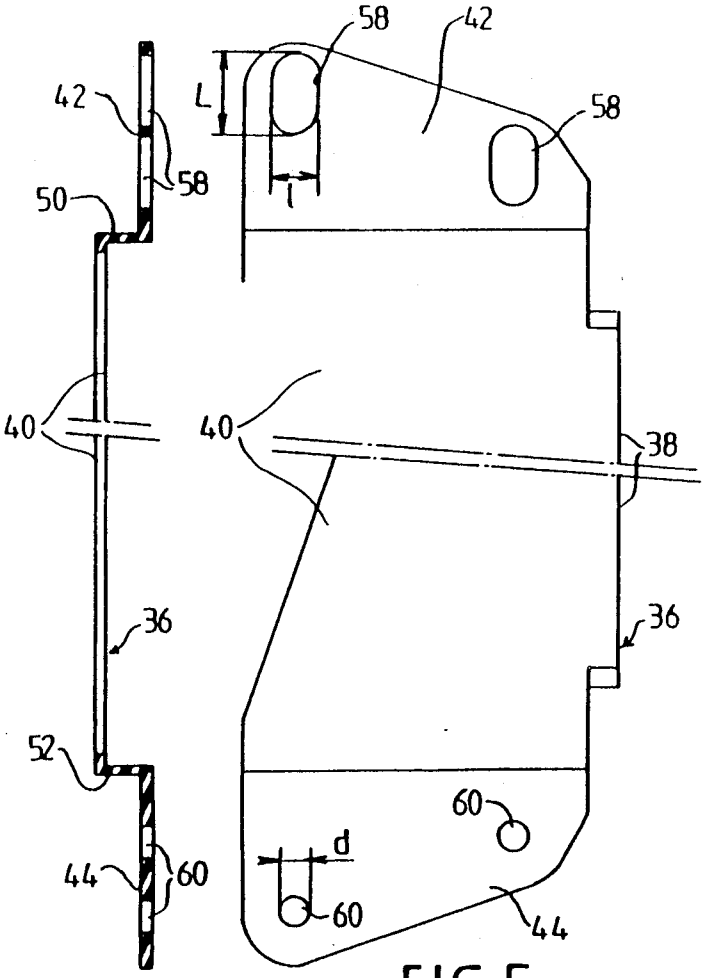
FIG.5
FIG.6
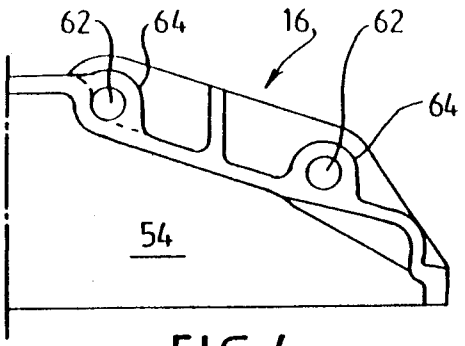
FIG.4
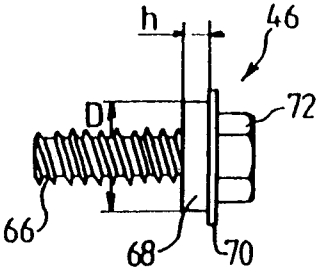
FIG.7
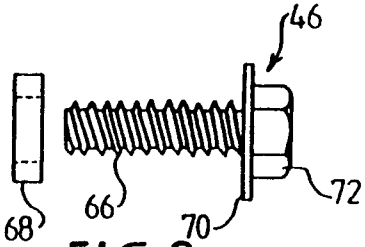
FIG.8
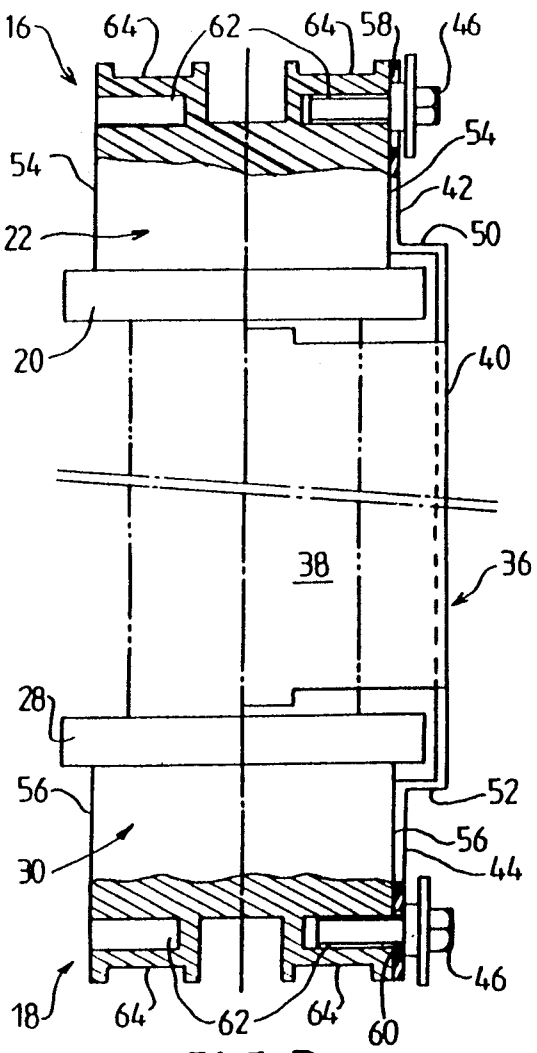
FIG.3

MOTOR VEHICLE HEAT EXCHANGER HAVING TWO INTERCONNECTED WATER BOXES

FIELD OF THE INVENTION

This invention relates to a heat exchanger having two interconnected water boxes, for motor vehicles and in particular for heavy goods vehicles.

BACKGROUND OF THE INVENTION

Heat exchangers of the above type are already known which comprise a bundle of tubes which are mounted between two water boxes or manifolds, each of which is delimited by a wall of moulded plastics material having two opposed lateral faces on which two mountings are fitted. Each of these mountings has a U-shaped transverse cross section, and joins the two water boxes together while the two mountings enclose the tube bundle between them. Each mounting comprises a body portion or web from which two side portions extend.

The two mountings which join the water boxes together thus give the heat exchanger a high mechanical strength, which enables the heat exchanger to be made large so as to be suitable for mounting on a motor vehicle, and in particular a heavy goods vehicle. This is important because in such circumstances it is subjected in operation to high mechanical stresses, due in particular to engine vibrations and to variations in thermal expansion of the tubes in the bundle.

It is known, from the specification of European patent No. 115 795, to build such a heat exchanger in which each of the mountings is secured on each of the water boxes by means of at least one dowel or pin which passes right through the water box and through two apertures which are formed in the two opposed lateral portions of the mounting. Fitting of such dowels is complex and costly in practice.

It is also known from European patent No. 112 251 to construct a heat exchanger of similar type, in which the water boxes are made of cast metal, and in which the appropriate portions of a mounting are secured on a lateral face of a water box by means of at least one bolt which passes through an aperture formed in that portion of the mounting, being screwed into a threaded hole, which is provided for this purpose within the thickness of the water box wall. Here again, however, the fastening operation is time-consuming and expensive to carry out, because it requires two successive machining operations on each water box so as initially to form in it a plurality of holes or apertures, and this has to be followed by threading operations.

DISCUSSION OF THE INVENTION

A main object of the invention is to overcome the drawbacks discussed above. To this end, according to the invention, in a heat exchanger of the type defined in the section "Field of the Invention" above, in order to secure a lateral portion of a mounting on a lateral wall of a water box, in each case a self-tapping screw is used which passes through an aperture formed in the said portion and which engages in a bore formed in the wall of the water box.

Under these conditions, fastening of the two mountings on the two water boxes is carried out in a particularly simple manner, since the bores may be made by moulding with the water boxes, and because also fitting of the self-tapping screws is carried out in a simple screwing operation by means of an appropriate tool.

The invention is particularly applicable to a heat exchanger of this type in which each mounting includes (in a manner which is known per se) an end portion which is formed with circular apertures for rigid fastening on to one of the two water boxes, and an end portion which is provided with oblong apertures for fastening on another water box, in such a way as to enable relative sliding movement to occur between that end portion and the corresponding water box so as to compensate for variations in expansion.

In accordance with a further feature of the invention, it is therefore accordingly provided tht each of the self-tapping screws is formed with a cylindrical ring having an outer diameter greater than the internal diameter of each of the circular apertures but smaller than the smallest dimension of each of the oblong apertures. Thus in the case in which a self-tapping screw is introduced into a circular aperture, the ring comes into engagement against the lateral portion of the mounting. By contrast, when the self-tapping screw is introduced into an oblong aperture of a mounting, the ring of the screw enters into the oblong aperture and comes into direct engagement against the corresponding lateral face of the water box.

This arrangement enables self-tapping screws of the same type to be used both for the rigid fastening of a mounting on one water box and for the sliding fastening of the mounting on the other water box.

The ring may be integral with the self-tapping screw, or it may be a separate component which is fitted around the screw.

According to another preferred feature of the invention, each of the lateral portions of a mounting includes, or is joined to, an end portion through a shoulder portion such as to enable the end portion to lie flat against the corresponding face of the water box. This gives an improved joint between the mounting and the water box.

The invention also includes the alternative case in which each of the lateral portions is aligned, or coplanar, with the corresponding end portions, in such a way that the end portion bears against a face which is offset from the face of the water box.

According to yet another preferred feature of the invention, each of the bores is blind, and is formed in a boss which is formed in the wall of the water box.

Preferred embodiments of the invention will be described below, by way of example only and with reference to the accompanying drawings.

BRIEF DESCRIPTION OF THE DRAWINGS

FIG. 3 is a diagrammatic side view, partly cut away, of a heat exchanger in accordance with the invention.

FIG. 4 is a view of parts of one of the side faces of one of the water boxes.

FIG. 5 is a side view of one of the mountings of the heat exchanger.

FIG. 6 is a corresponding side view.

FIG. 7 shows a self-tapping screw with an integrated ring.

FIG. 8 shows a self-tapping screw with an applied ring.

DESCRIPTION OF PREFERRED EMBODIMENTS OF THE INVENTION

Figure 2:
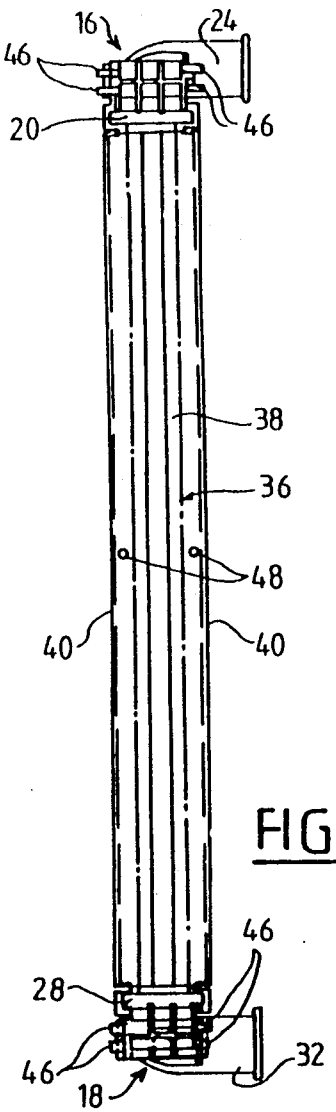
FIG. 2 is a side view of the heat exchanger of FIG. 1.
Figure 1:
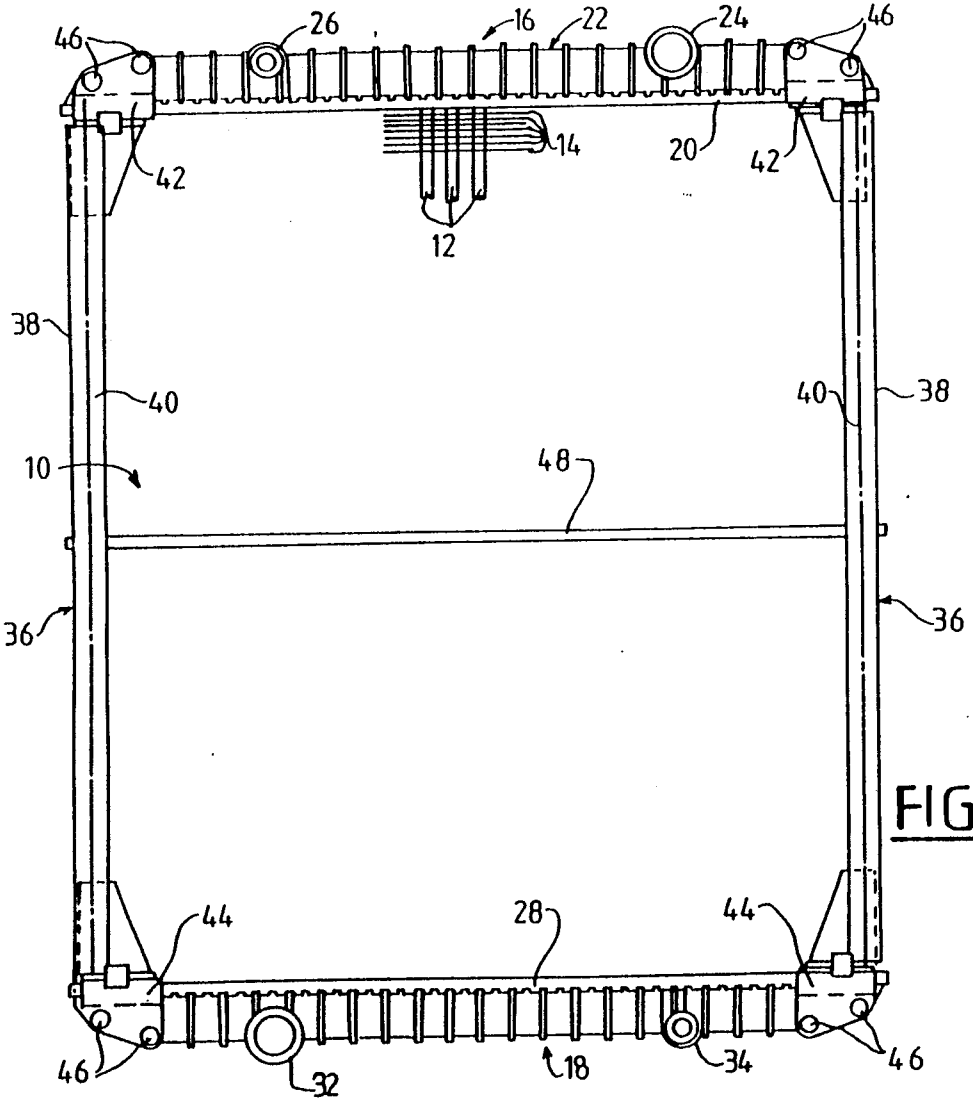
FIG. 1 is a view in elevation of a heat exchanger in accordance with the invention.

The heat exchanger shown in FIGS. 1 and 2 comprises a bundle 10 which is formed of a multiplicity of tubes 12 extending through fins 14, the tube bundle being mounted between two water boxes or manifolds 16 and 18.

The water box 16 which is situated in the upper part of the heat exchanger, includes a collecting plate 20, otherwise referred to as a perforated plate, into which the ends of the tubes 12 of the tube bundle are open. The water box 16 is delimited by a wall 22 of moulded plastics material, which is secured on the perimeter of the collecting plate 20. The wall 20 has an inlet pipe branch 24 and a degassing pipe branch 26.

The water box 18, which is at the lower end of the heat exchanger, includes a collecting plate 28 into which the other ends of the tubes 12 are open. It also includes a moulded wall of plastics material in which an outlet pipe branch 32 and a drain pipe branch 34 are formed.

The two water boxes 16 and 18 are joined together by two mountings 36, each having a U-shaped transverse cross section. The mountings 36 include a body portion 38 from which two lateral portions 40 extend. Each of the two lateral portions 40 includes an end portion 42 which is of generally triangular cross section and which is adapted to be fixed on the water box 16. Each lateral portion 40 also has, at its other end, a further end portion 44, again of generally triangular shape and adapted to be secured on the water box 18. Each of the end portions 42 or 44 is secured to the corresponding water box by means of a self-tapping screw 46. Thus, as shown in FIGS. 1 and 2, each of the mountings 36 is secured to one of the two water boxes by means of four self-tapping screws 46, so that the heat exchanger has a total of sixteen self-tapping screws. The two mountings 36 thus contain the tube bundle 10 between them.

The mountings 36 are also joined together, substantially at mid height, by means of a stretcher 48 (in this example two stretchers), extending transversely to the tubes 12 of the bundle.

As can be seen in FIG. 3, each of the lateral portions 40 of each mounting 36 has a shoulder element 50 joining it to its upper end portion 42, together with a further shoulder element 52 joining it to its lower end portion 44. The two end portions 42 and 44 may thus be applied flat against the water boxes 16 and 18 respectively, extending around the lateral projections seen in FIG. 3, which are defined by the collecting plates 20 and 28.

As shown in FIG. 3, the wall 22 of the upper water box 16 has two opposed faces 54, which are substantially parallel to each other and on which the two end portions 42 of one of the mountings 36 are secured. Similarly, the wall 30 of the lower water box 18 has two opposed faces 56 which are again parallel to each other and on which the two end portions 44 of the same mounting 36 are secured respectively.

Each of the end portions 42 (FIGS. 3, 5 and 6) is provided with two generally oblong apertures 58, while each of the end portions 44 has two circular apertures 60, to enable each mounting 36 to be secured rigidly on to the water box 18, while being secured on the water box 16 in such a way that relative sliding movement can occur between the mounting and the water box 16. As can be seen in FIG. 5, each of the oblong apertures 58 has a width l which is greater than the diameter d of the circular aperture 60. The length L of each oblong aperture 58 is greater than its width l, and extends in the same direction as the length of the mounting, so as to enable there to be a mutual displacement of the two water boxes with respect to each other under the effect of differences in expansion in the tubes 12 of the bundle caused by the temperature of the fluid passing through them.

In each of the opposed faces 54 of the upper water box 16 and in each of the opposed faces 56 of the lower box 18, smooth-walled bores 62 are formed. These may for example be blind holes, and the axis of each of them extends at right angles to the plane containing the corresponding flat face 54 or 56. The bores 62 are formed by moulding integrally with the corresponding water box, and are formed in bosses 64 which are formed in the wall 22 of the water box 16 or in the wall 30 of the lower water box 18, as the case may be.

The self-tapping screw 46 shown in FIG. 7 comprises, in succession, a threaded shank 66, a ring 68 in the form of a collar having an outer diameter D and a depth h, a ring portion 70 the diameter of which is greater than D, and finally a hexagonal head 72. The diameter D of the ring 68 is greater than the diameter d of the corresponding circular aperture 60, and smaller than the width l of the corresponding oblong aperture 58. The depth h of the ring 68 is greater than the thickness, e, of the end portion 42 or 44 of a lateral portion 44 of a support 36.

Thus, as is best seen in FIG. 3, the ring 68 of a self-tapping screw 46 comes into engagement against the end portion 44 around an aperture 60, thus enabling the end portion 44 to be gripped against a face 56 of the water box 18. By contrast, when a self-tapping screw 46 is engaged in one of the oblong apertures 58 of an end portion 42, the ring 68 comes into direct engagement against the corresponding face 54 of the water box 16. The end portion 42 is thus able to undergo relative sliding movement with the water box 16, while being fastened to it.

In the modified version of the self-tapping screw 46 shown in FIG. 8, the ring 68, instead of being integral with the remainder of the screw, is applied to the latter by simple insertion of the shank of the screw into the ring.

Given that the bores 62 may be formed by moulding integrally with the two water boxes, and that the self-tapping screws 46 are introduced by simple forced screwing action into the bores 62, the operations of fitting and securing the mountings 36 are very much simplified than is the case with the heat exchangers of the prior art. In addition, within the scope of the invention it can be envisaged that each of the lateral portions 40 is made without the shoulder elements 50. The end portion 42 of each support 36 is then in the same plane as the lateral portion 40, while the faces of the bores 62 facing towards the end portion lie beyond the face of the wall 54, 56 of the water box. With this arrangement, the lateral portions 40 no longer bear directly against the faces of the water box, but instead engage against the end of the projecting bosses 62.

What is claimed is:

1. A heat exchanger comprising a first water box; a second water box; a bundle of tubes extending between said first and second water boxes; two mountings, each having a U-shaped transverse cross section and together enclosing the tube bundle between them, whereby to connect said water boxes together; and at least one self-tapping screw securing the mountings to the water boxes, wherein each water box is delimited by a wall of moulded plastics material defining two opposed lateral faces and having a bore formed therein, each of said mountings comprising a body portion and two lateral portions extending from the body portion, with each lateral portion defining at least one aperture and with a plurality of self-tapping screws each extending through a corresponding said aperture in a lateral portion, with at least one said screw associated with each said mounting engaging in a said bore in the wall of each water box, whereby each lateral portion is secured on a corresponding said lateral wall of a corresponding one of the water boxes by means of said at least one self-tapping screw, wherein in each said mounting, each lateral portion includes an end portion, said apertures being formed in the end portions, the latter comprising a first end portion in which said apertures are circular whereby said end portion can be rigidly secured on the first water box, and a second end portion in which said apertures are oblong whereby said second end portion can be secured slidingly on the second water box, each self-tapping screw having a cylindrical ring defining an outer diameter greater than the diameter of a said circular aperture but smaller than the smallest dimension of a said oblong aperture.

2. A heat exchanger according to claim 1, wherein the said ring is an integral part of the self-tapping screw.

3. A heat exchanger according to claim 1, wherein the said ring is a separate component fitted around the self-tapping screw.

4. A heat exchanger according to claim 1, wherein each said mounting further includes a shoulder element joining each of its said end portions to the remainder of the corresponding lateral portion, whereby each said end portion lies flat against the corresponding face of the corresponding water box.

5. A heat exchanger according to claim 1, wherein said wall of each water box is formed with a boss, the corresponding said bore being formed in the boss.

6. A heat exchanger according to claim 1 wherein each lateral portion includes an intermediate portion disposed between the associated end portions of said lateral portion, each of said end portions being offset from its associated intermediate portion, such that each end portion bears directly against its associated water box.

* * * * *